US008327810B2

(12) United States Patent
Arnold et al.

(10) Patent No.: US 8,327,810 B2
(45) Date of Patent: Dec. 11, 2012

(54) HIGH EFFICIENCY WATER HEATER

(75) Inventors: George R. Arnold, Sutherland, VA (US); Donald E. Woollen, Largo, FL (US)

(73) Assignee: Armstrong Hot Water Inc., Three Rivers, MI (US)

( * ) Notice: Subject to any disclaimer, the term of this patent is extended or adjusted under 35 U.S.C. 154(b) by 729 days.

(21) Appl. No.: 12/571,463

(22) Filed: Oct. 1, 2009

(65) Prior Publication Data

US 2010/0018475 A1 Jan. 28, 2010

Related U.S. Application Data

(63) Continuation-in-part of application No. 11/678,700, filed on Mar. 16, 2007.

(51) Int. Cl.
*F24H 1/48* (2006.01)

(52) U.S. Cl. ..... 122/18.1; 126/367.1; 126/368.1

(58) Field of Classification Search ..... 122/15.1, 122/18.1, 18.3, 31.1, 136 R; 126/367.1, 126/368.1, 381.1, 382.1, 350.1, 357.1, 344
See application file for complete search history.

(56) References Cited

U.S. PATENT DOCUMENTS

| | | | | |
|---|---|---|---|---|
| 2,232,366 | A | 2/1941 | Chappell | |
| 2,794,426 | A | 6/1957 | Lowery | |
| 3,159,306 | A | 12/1964 | Lyall | |
| 3,757,745 | A | 9/1973 | Miller | |
| 4,296,799 | A | 10/1981 | Steele | |
| 4,524,726 | A | 6/1985 | Bindl | |
| 4,653,663 | A | 3/1987 | Holtsclaw | |
| 4,938,204 | A | 7/1990 | Adams | |
| 4,981,112 | A | 1/1991 | Adams et al. | |
| 5,313,914 | A | 5/1994 | Woollen | |
| 5,337,728 | A | 8/1994 | Maruyama | |
| 5,395,230 | A | 3/1995 | Ferguson | |
| 5,537,955 | A | 7/1996 | Wu | |
| 5,579,756 | A * | 12/1996 | Jonsson | 126/101 |
| 5,666,943 | A | 9/1997 | Adams | |
| 6,612,267 | B1 * | 9/2003 | West | 122/13.3 |
| 6,945,197 | B2 | 9/2005 | Ryoo | |
| 7,258,080 | B2 * | 8/2007 | Missoum et al. | 122/18.1 |
| 7,290,503 | B2 * | 11/2007 | Missoum et al. | 122/18.1 |
| 7,832,364 | B2 * | 11/2010 | Liu | 122/18.1 |

* cited by examiner

*Primary Examiner* — Gregory A Wilson
(74) *Attorney, Agent, or Firm* — Larson & Larson, P.A.; Frank Liebenow; Justin Miller

(57) ABSTRACT

An application for a method of heating water includes transferring the water from a water supply into an inner tank of the water heater which is held within an outer tank, transferring the water from the inner tank into an outer tank and then to supply a building with hot water. The water in the outer tank is heated with hot gasses, partially cooling to intermediate temperature gasses. The water in the inner tank is heated with the intermediate temperature gasses, further cooling the intermediate temperature gasses into cooler gasses that are then exhausted out of the water heater.

15 Claims, 10 Drawing Sheets

HIGH EFFICIENCY WATER HEATER

CROSS-REFERENCE TO RELATED APPLICATION

This is a continuation-in-part application to U.S. patent application Ser. No. 11/678,700, filed Mar. 16, 2007, inventor George R. Arnold and Donald E. Woollen, the disclosure of which is herein incorporated by reference.

FIELD OF THE INVENTION

This invention relates to the field of gas and/or oil fired water heaters and more particularly to an efficient system for utilizing gas and/or oil combustion to heat water.

BACKGROUND OF THE INVENTION

Water heaters for commercial and home use are well known in the industry. The most common water heaters have a water tank and a series of heat exchange tubes immersed in the water. Hot gasses from the combustion of gas and/or oil are circulated through the tubes, thereby heating the tubes and transferring heat to the surrounding water. These water heaters utilize what is known as thermal stacking—hot water moves toward the top of the tank. In such, the heat exchanger is located toward the bottom of the tank in the coolest water to maximize condensing. This type of design requires a tall water heater tank requiring space and does not allow for multiple heaters to be stacked. Any mixing of the hot water with the cold or conduction through the tank walls will increase the temperature of the water at the bottom of the tank and reduce condensation and hence, reduce efficiency.

In general, the amount of heat energy delivered to the water from the combustion (hot gasses) is proportional to the difference in temperature between the water and the hot gasses. It is further proportional to the area of the heat exchange tubes—the greater the area, the higher the efficiency. For example, water that is at 55° accepts more heat from gasses that are at a particular temperature than water that is at 95°. As the water heats, more heat from the hot gasses passes out the exhaust system and into the atmosphere.

To reduce the amount of wasted heat, multi-stage water heaters have been devised to increase the length, an therefore area, of the exchange tubes. For example, U.S. Pat. No. 4,938,204 to Adams which is hereby incorporated by reference. The disclosed water heater extends the length/area of heat exchange through the use of a second set of heat exchangers. In one embodiment, the second set of heat exchangers are immersed within the same hot water as the first set while in a second embodiment, each is submersed in a separate water tank, the water outflow from the tank with the second set of heat exchangers feeding the water inflow of the other water tank. In this design, the cold water in a first tank is heated by the first set of heat exchangers, and then the exhaust heat from the first set of heat exchangers passes through a second set of heat exchangers immersed within the second tank. The described embodiments have improvements in efficiency over prior water heaters, but requires two large-sized water tanks, both having an outer surface exposed to ambient air, a major factor in energy loss.

What is needed is a high efficiency water heater that effectively transfers a maximum amount of heat from the heat source to the water while reducing losses to the ambient air.

SUMMARY OF THE INVENTION

Water is heated by transferring the water from a water supply into an inner tank of the water heater which is held within an outer tank, transferring the water from the inner tank into an outer tank and then to supply a building with hot water. The water in the outer tank is heated with hot gasses, partially cooling to intermediate temperature gasses. The water in the inner tank is heated with the intermediate temperature gasses, further cooling the intermediate temperature gasses into cooler gasses that are then exhausted out of the water heater In one embodiment, a water heater is disclosed including an outer tank with an inner tank contained within the outer tank. A cover plate has a cold water inlet aperture, a hot water outlet aperture, a heat input aperture and a plurality of exhaust apertures. The cold water inlet aperture is coupled into the inner tank, thereby providing a source of cold water to the inner tank and the hot water outlet aperture is coupled to the outer tank, thereby providing an exit for heated water from the water heater. A source of heat forces hot gasses into the heat input aperture. A heat transfer pipe is interfaced between the heat input aperture and a plenum and the plenum is interfaced to a first end of each of a plurality of heat exchange tubes. A distal end of each of the heat exchange tubes is interfaced to one of the plurality of exhaust apertures. A manifold interfaces the plurality of exhaust apertures to an exhaust pipe.

In another embodiment, a method of heating water includes transferring water from a water supply into an inner tank, which is held within an outer tank, transferring the water from the inner tank into an outer tank and supplying hot water to a building from the outer tank. The water in the outer tank is heated with hot gasses. The water in the outer tank partially cools the hot gasses into intermediate temperature gasses and the water in the inner tank is heated with the intermediate temperature gasses. The water in the inner tank further cools the intermediate temperature gasses into cooler gasses which are then exhausted from the water heater.

In another embodiment, a water heater is disclosed including an outer tank with an inner tank contained within the outer tank. A cover plate has a cold water inlet aperture, a hot water outlet aperture, a heat input aperture and a plurality of exhaust apertures. The cold water inlet aperture is coupled to the inner tank, thereby providing a source of cold water to the inner tank. The hot water outlet aperture is coupled to the outer tank, thereby providing an exit for heated water from the water heater. A Plumbing is provided to route hot gasses from the heat input aperture and through the outer tank to a plenum, thereby transferring some heat from the hot gasses to the water in the outer tank. Plumbing is also provided to route the hot gasses from the plenum to the plurality of exhaust apertures, transferring heat from the hot gasses to water present in the inner tank. The hot gasses (which are now cooled) are then routed to an exhaust pipe.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
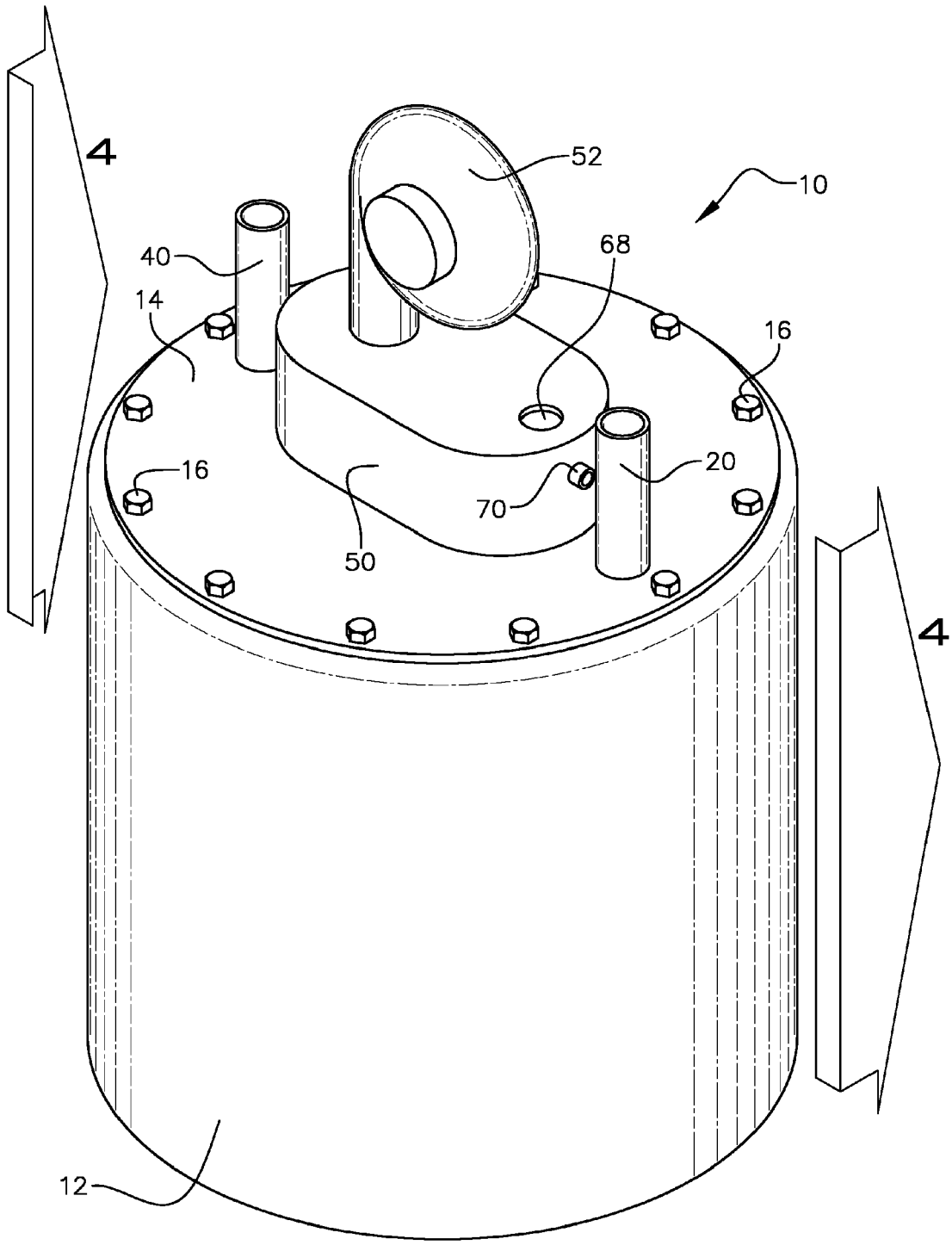
FIG. 1 illustrates an isometric view of a water heater of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a water heater of a first embodiment of the present invention is shown. The water heater 10 includes an outer tank 12 with a cover plate 14 secured to the outer tank 12 by fasteners 16. In this example, the fasteners are bolts 16 but any type of fastener is acceptable. In some embodiments the cover plate 14 is permanently affixed to the outer tank 12 by adhesive or weld. Apertures in the cover plate 14 are provided to inlet cold water, outlet hot water, input hot gases from the burner 52, outlet intermediate hot gases, inlet intermediate hot gases and outlet exhausts. It is anticipated that in some embodiments, the cover plate 14 also has apertures for other needs such as pressure relief valves, thermostats, drains, etc.

A conventional gas, oil or gas/oil burner 52 is the source of hot gasses. Cold water enters into the cold water inlet pipe 20 and hot water exits out of the hot water outlet pipe 40. Exhaust gases exit through an exhaust 68 which is normally connected to a chimney or other vent. Because of humidity in the hot gases condensing when contacting the colder heat exchange jackets, a condensation drain 70 is provided in some embodiments. Hot gases are routed through the heat exchanger then out the exhaust.

Figure 2:
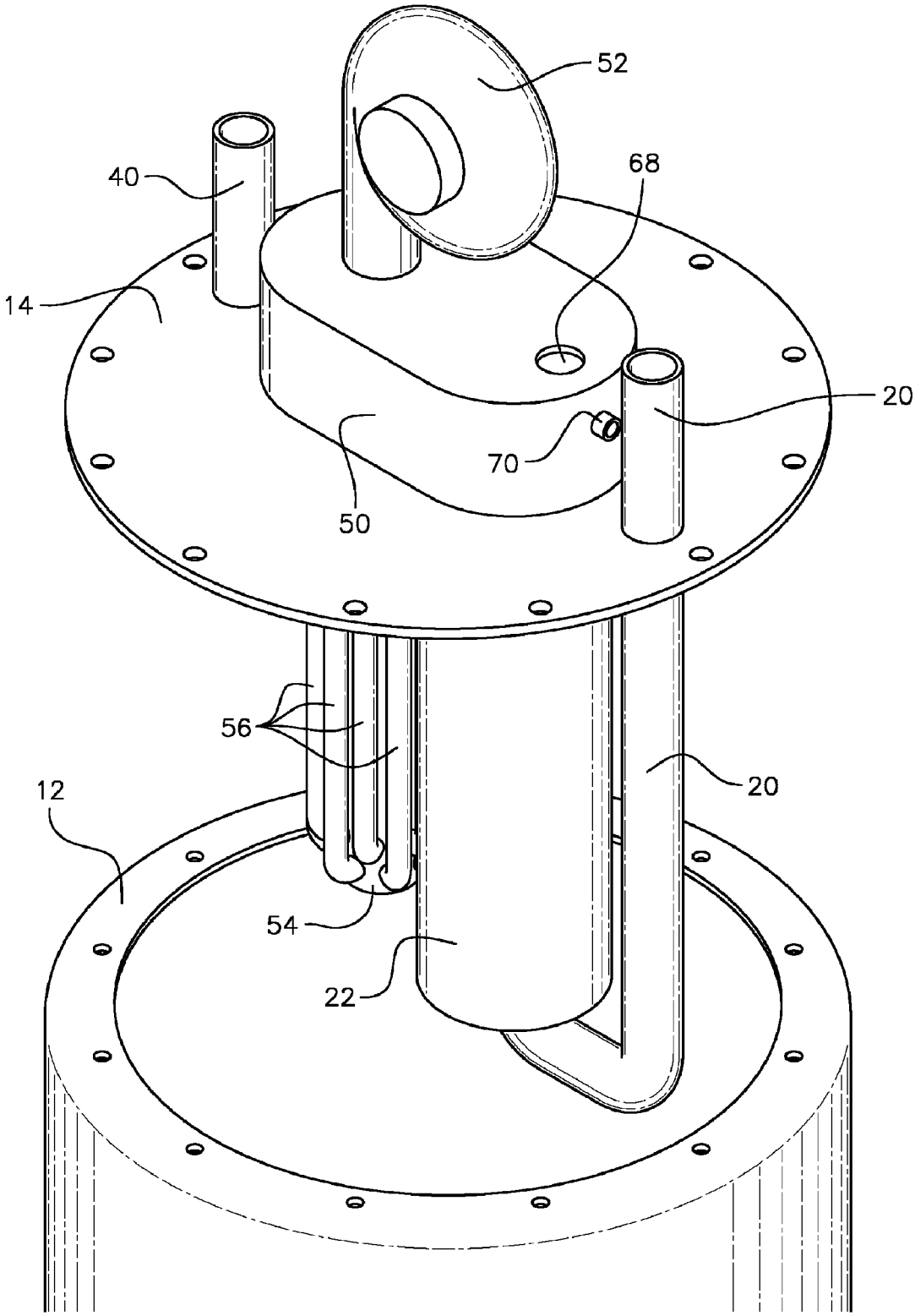
FIG. 2 illustrates an isometric view of a water heater of a first embodiment of the present invention showing internal plumbing.

Referring to FIG. 2, an isometric view of a water heater of a first embodiment of the present invention showing internal plumbing is shown. In this view, the cold water inlet pipe 20 connects to the inner condensing chamber jacket 22 and the bottom of the firing chamber 54 and first set of heat exchange tubes 56 are visible. Cold water enters through the cold water inlet pipe 20 and into the inner condensing chamber jacket 22 where it is pre-heated as will be shown in FIG. 4.

Figure 3:
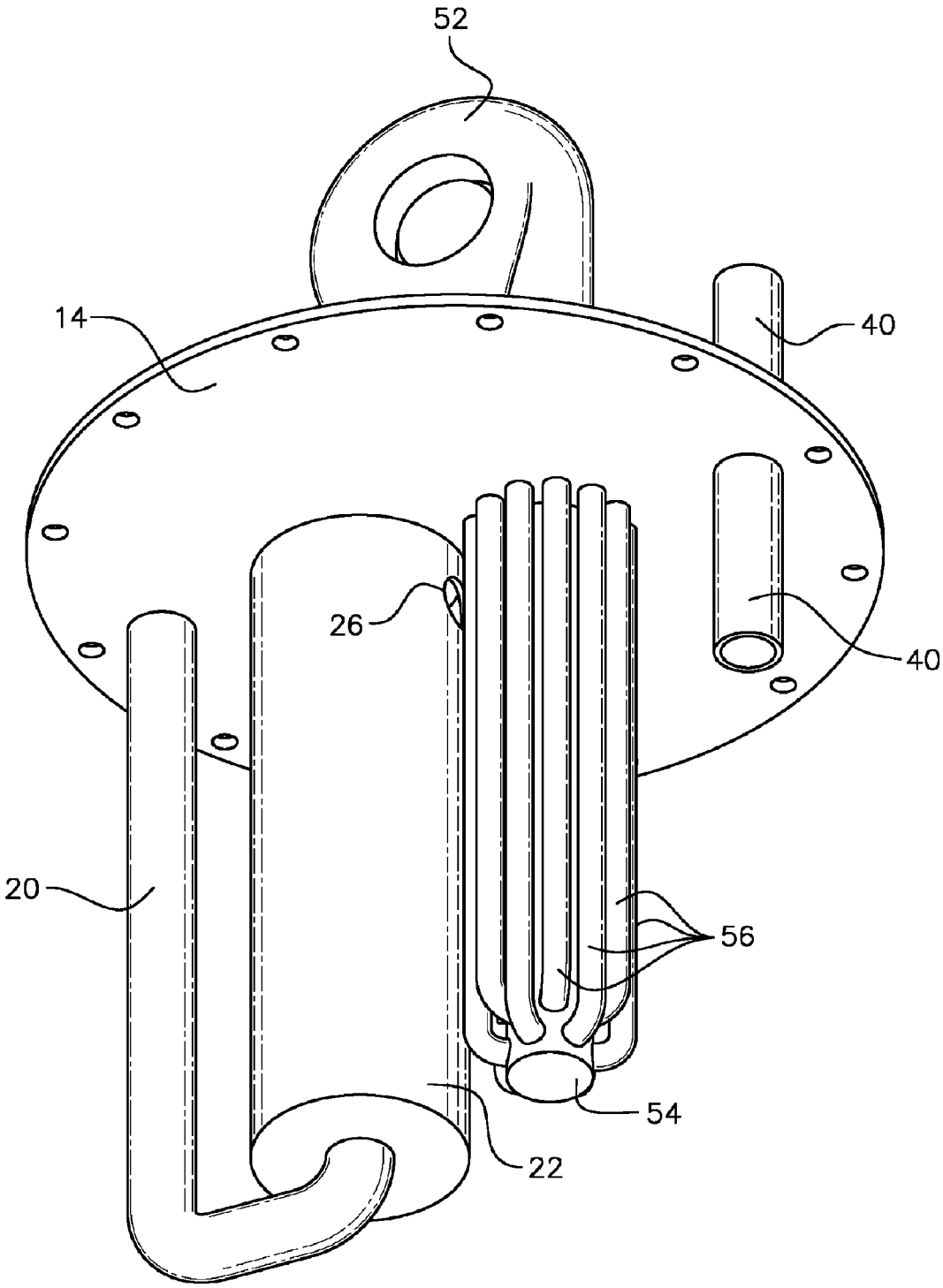
FIG. 3 illustrates a second isometric view of a water heater of a first embodiment of the present invention showing internal plumbing.

Referring to FIG. 3, a second isometric view of a water heater of a first embodiment of the present invention showing internal plumbing is shown. The pre-heated water exits the condensing chamber jacket 22 through one or more interface ports 26 into the outer tank 12 (not shown in FIG. 3) where it is further heated by the firing chamber 54 and heat exchange tubes 56.

Figure 4:
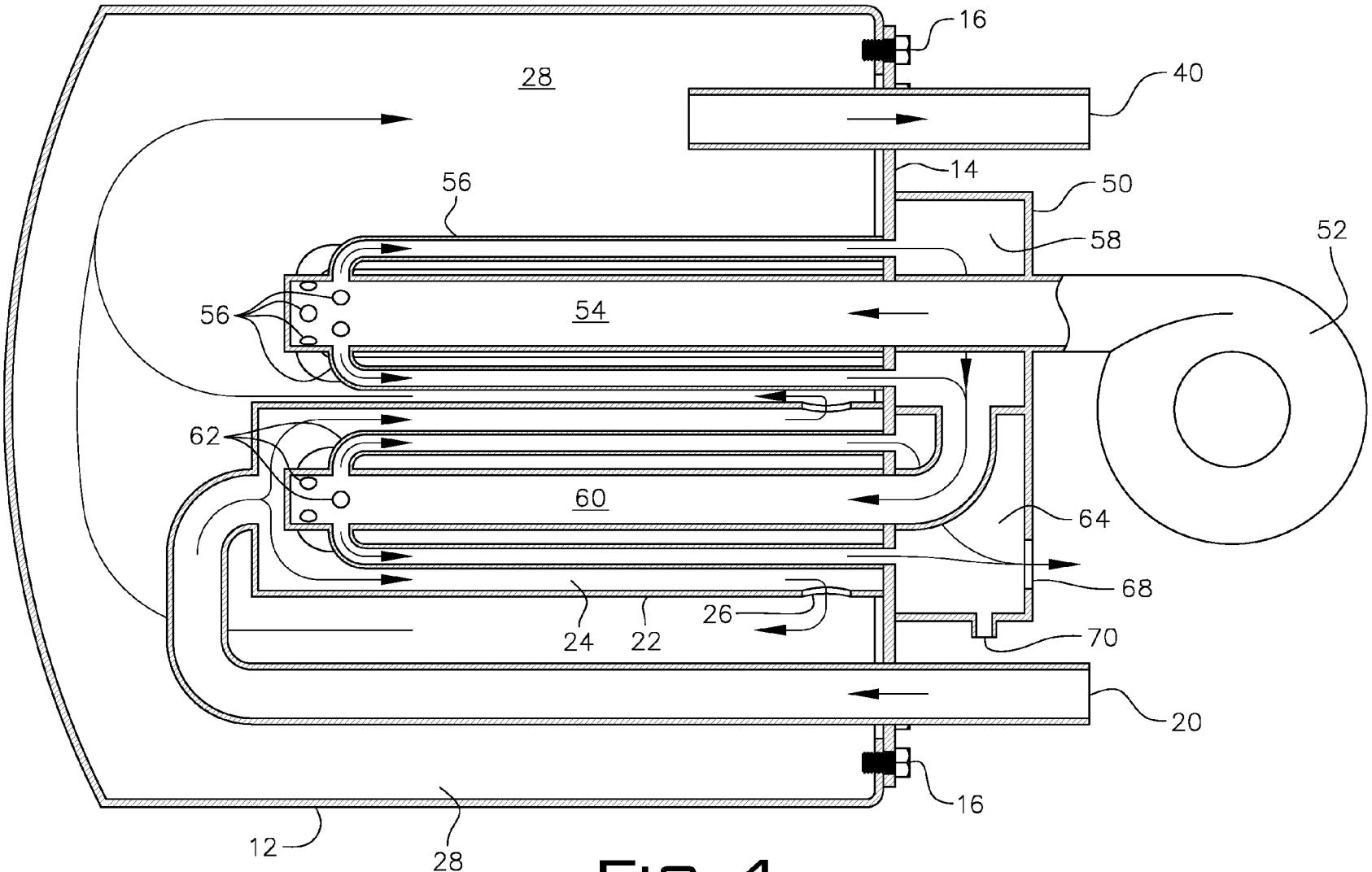
FIG. 4 illustrates a cross-section along line 4-4 of FIG. 1.

Referring to FIG. 4, a schematic view of a water heater of the present invention is shown. The burner 52 provides hot gases into the firing chamber 54 that heat the outer surface of the firing chamber 54 then exit through the heat exchanger tubes 56 which are also heated by the hot gases. The firing chamber 54 and the heat exchanger tubes 56 are immersed in water 28 within the outer tank 12 and, thereby, transfer heat to the surrounding water 28 held within the outer tank 12. The hot gases at a reduced temperature exit the heat exchanger tubes 56 into a first chamber 58 of the manifold 50 and are directed through a heat transfer chamber 60, then through a second set of heat exchange tubes 62. The hot gases (at a reduced temperature) heat the heat transfer chamber 60 and the second set of heat exchange tubes 62. The heat transfer chamber 60 and the second set of heat exchange tubes 62 are immersed in colder water 24 held within the inner condensing chamber jacket 22, thereby transferring heat to that water 24 held within the inner condensing chamber jacket 22. To make the water heater 10 more efficient, water vapor in the hot gases condenses due to the colder temperature of the water 24 held within the inner condensing chamber jacket 22. This is due to the fact that the heat transfer chamber 60 and the second set of heat exchange tubes 62 are immersed in colder water 24. Additionally, the inner condensing chamber jacket 22 is contained substantially within the outer tank 12. Therefore, heat escaping through those walls of the inner condensing chamber jacket 22 is directed into the water 28 within the outer tank.

It is anticipated that, rather than passing intermediate hot gases out of the outer tank and then back into the outer tank through the manifold, in another embodiment an equivalent apparatus passes intermediate hot gases directly within the outer tank.

After exiting the heat exchange tubes 62, the hot gases (at a further reduced temperature) exit through a second chamber 64 of the manifold 50 and exit through the exhaust coupling 68. Any condensation exits through a condensation outlet 70.

Water enters the water heater 10 through the cold water inlet 20 and into the bottom of the inner condensing chamber jacket 22, passing over the heat transfer chamber 60 and the second set of heat exchange tubes 62 before exiting through warm water apertures 26 and into the outer tank 12. The water 28 in the outer tank 12 is heated by the firing chamber 54 and the first set of heat exchange tubes 56 and the hot water 28 then exits the water heater 10 through the hot water outlet 40.

Figure 5:
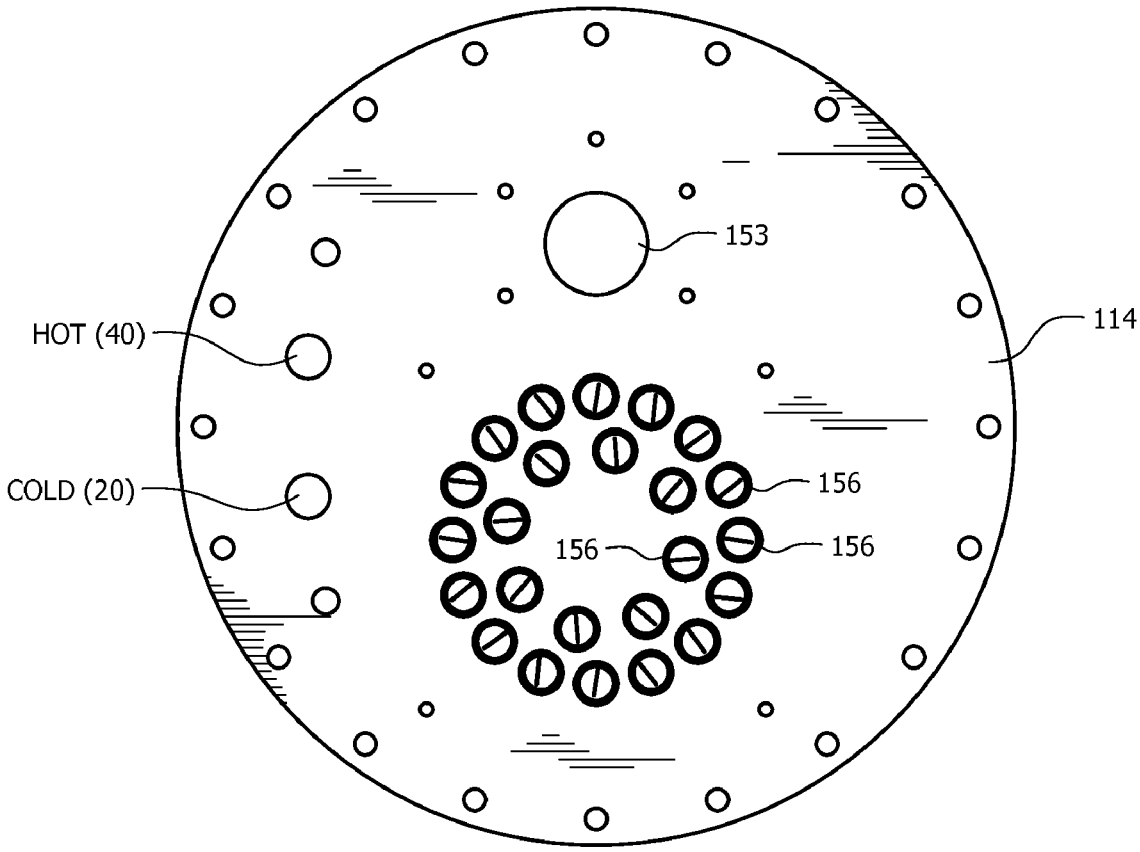
FIG. 5 illustrates a plan view of a water heater of a second embodiment of the present invention.

Referring to FIG. 5, a plan view of a water heater of a second embodiment of the present invention is shown. This embodiment encompasses the same basic principle of an inner condensing chamber and a heat transfer chamber but has a different arrangement of components. In such, the hot gasses are in thermal contact with the pre-heated water in the heat transfer tank before the hot gasses come into contact with the water from the supply in the condensing chamber.

Visible in FIG. 5 is the cover plate 114 with a cold water inlet 20 and a hot water outlet 40. Hot gases are provided through a hot gas input aperture 153 and exhaust gases exit through a plurality of heat exchange tubes 156 exiting through apertures in the cover plate 114. It is anticipated that in some embodiments, the cover plate 114 also has orifices/apertures for other needs such as pressure relief valves, thermostats, drains, etc.

Figure 6:
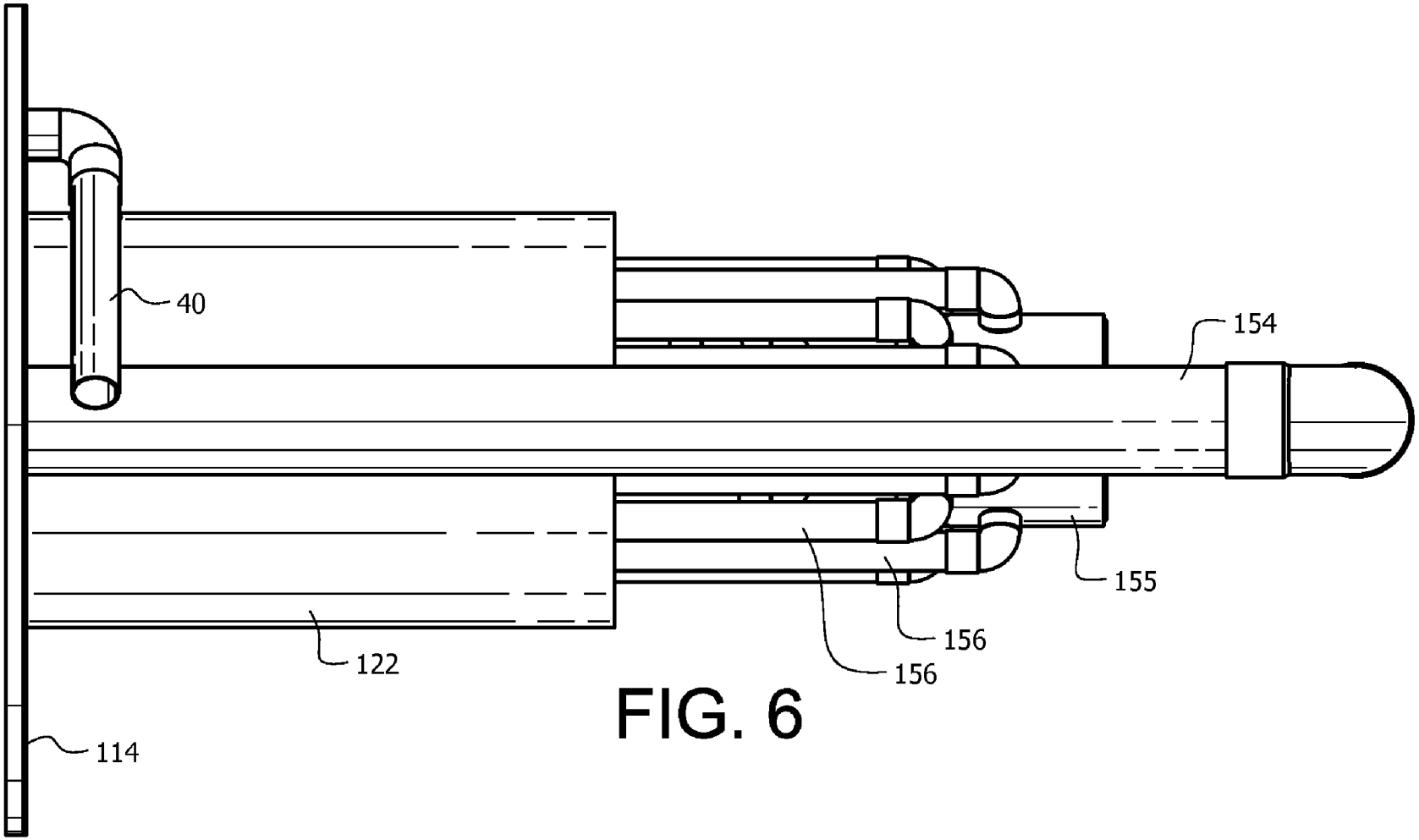
FIG. 6 illustrates a top isometric view of a water heater of a second embodiment of the present invention.

Referring to FIG. 6, a top isometric view of a water heater of a second embodiment of the present invention is shown. Hot gasses enter the heat transfer pipe 154 from the hot gas input aperture 153 and heat the already hot water within the outer tank 12 (see FIG. 9) then the slightly cooler gasses pass through the heat exchange tubes 156 and then out through a plenum 155. The hot gases flow from the hot gas input aperture 153, through the heat transfer pipe 154, through the heat exchange tubes 156 and then out the plurality of exhaust apertures 156. A first portion of the heat exchange tubes 156 are surrounded by and conduct to already heated water within the outer tank 12 and a second portion of the heat exchange tubes 156 are surrounded by colder water within condensing chamber (within the inner tank 122). Hotter gases enter the heat exchange tubes 156 near the plenum 155 and further heat and maintain the heat of water within the outer tank 12 and the gasses are slightly cooled by the hot water since the hot water is colder than the hot gases. The slightly cooler hot gases travel through the heat exchange tubes 156 into the inner tank 122 which is immersed in the cooler water from the cold water inlet 20. The temperature differential between the slightly cooler hot gases and the cooler water from the cold water inlet 20 provide for efficient heat transfer between the hot gases and the water in the condensing chamber (within the inner tank 122).

Figure 7:
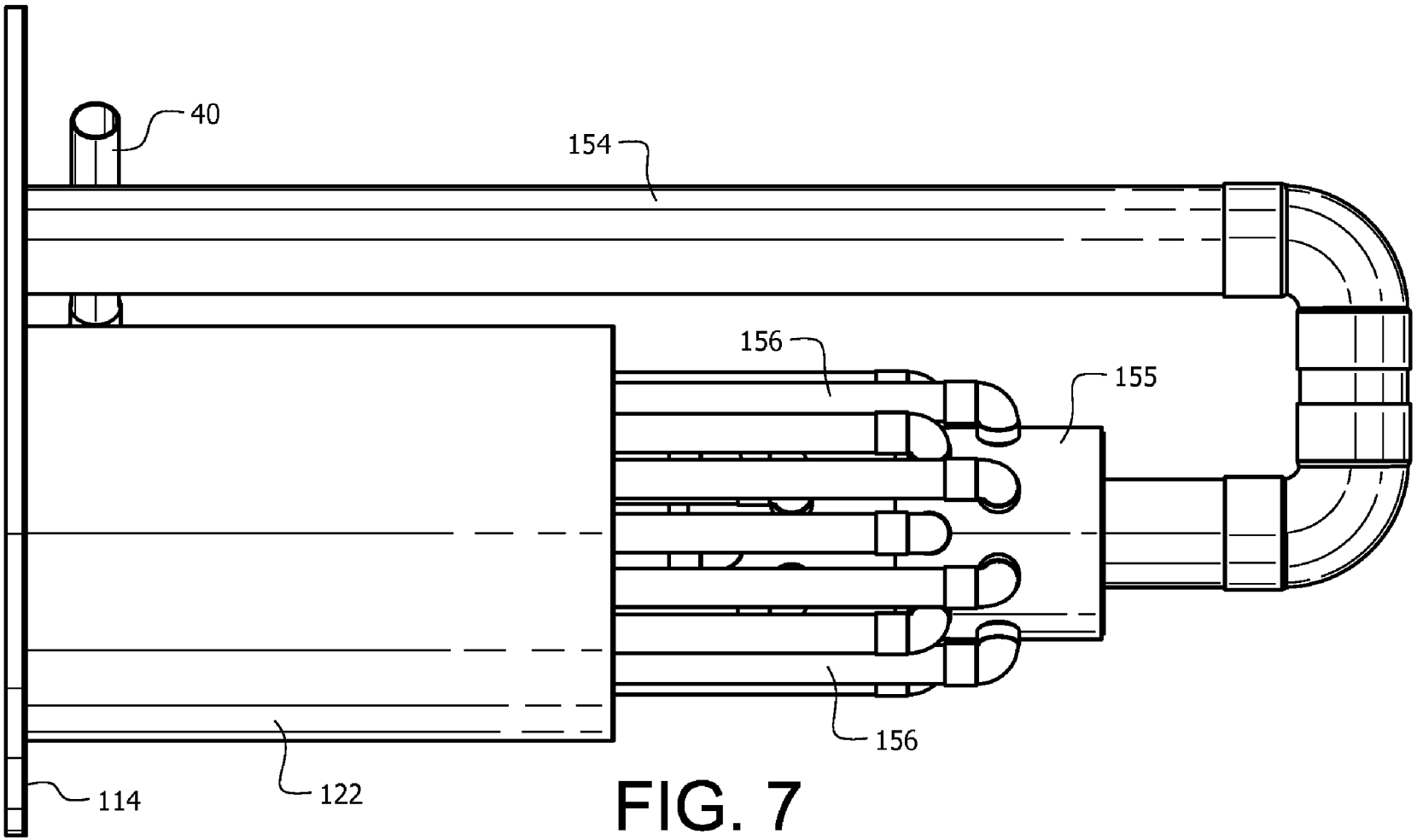
FIG. 7 illustrates a side isometric view of a water heater of a second embodiment of the present invention.

Referring to FIG. 7, a side isometric view of a water heater of a second embodiment of the present invention is shown. In this view, the plenum 155 is visible.

Figure 8:
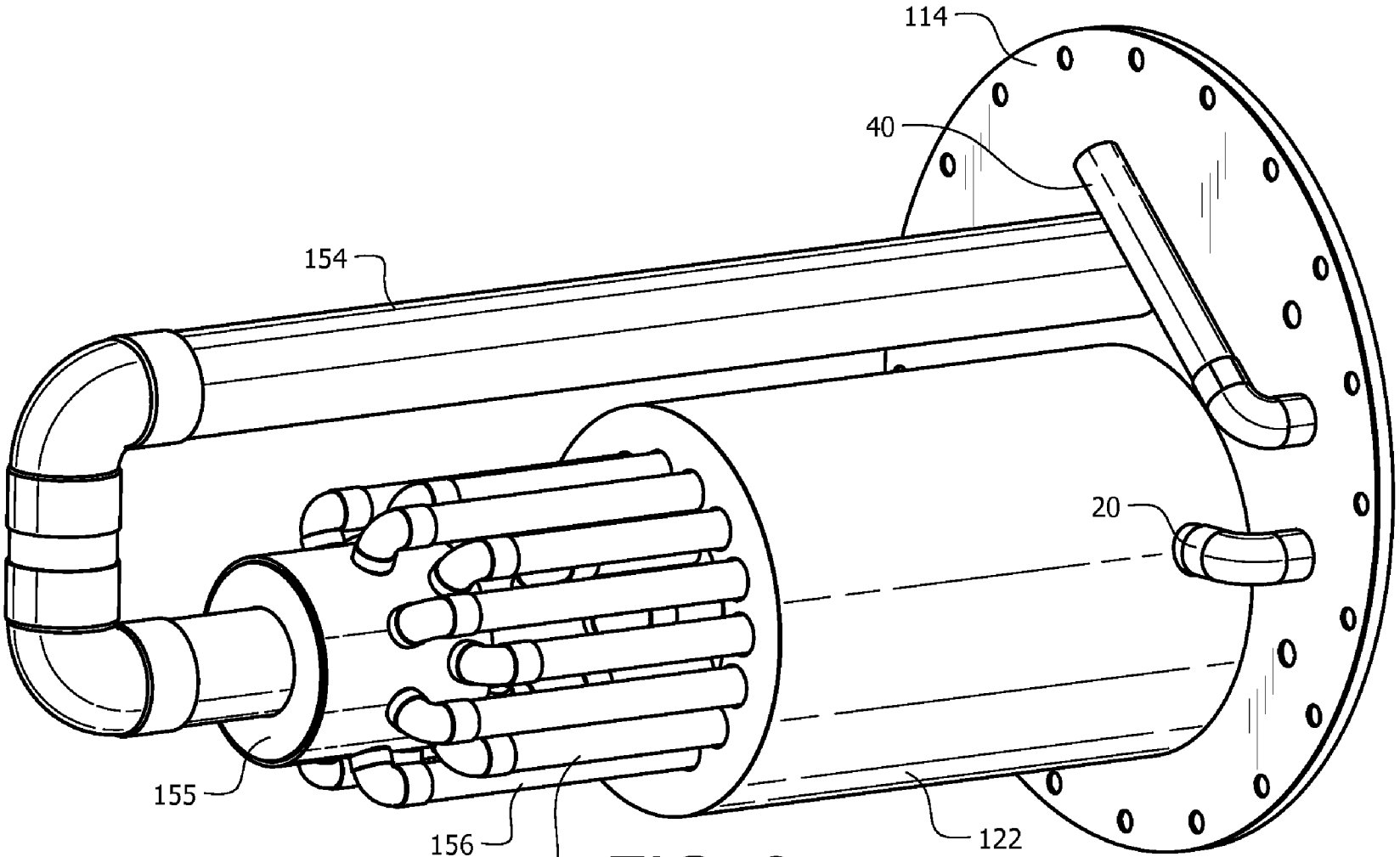
FIG. 8 illustrates a perspective view of a water heater of a second embodiment of the present invention.

Referring to FIG. 8, a perspective view of a water heater of a second embodiment of the present invention is shown. In this view, the cold water inlet 20 is shown passing through the cover plate 114 and through a side wall of the inner tank 122. Proper connections are made to reduce or eliminate leakage between the cold water inlet 20. Proper connections are made to reduce or eliminate leakage between the cold water inlet 20 and the side wall of the inner tank 122.

Figure 9:
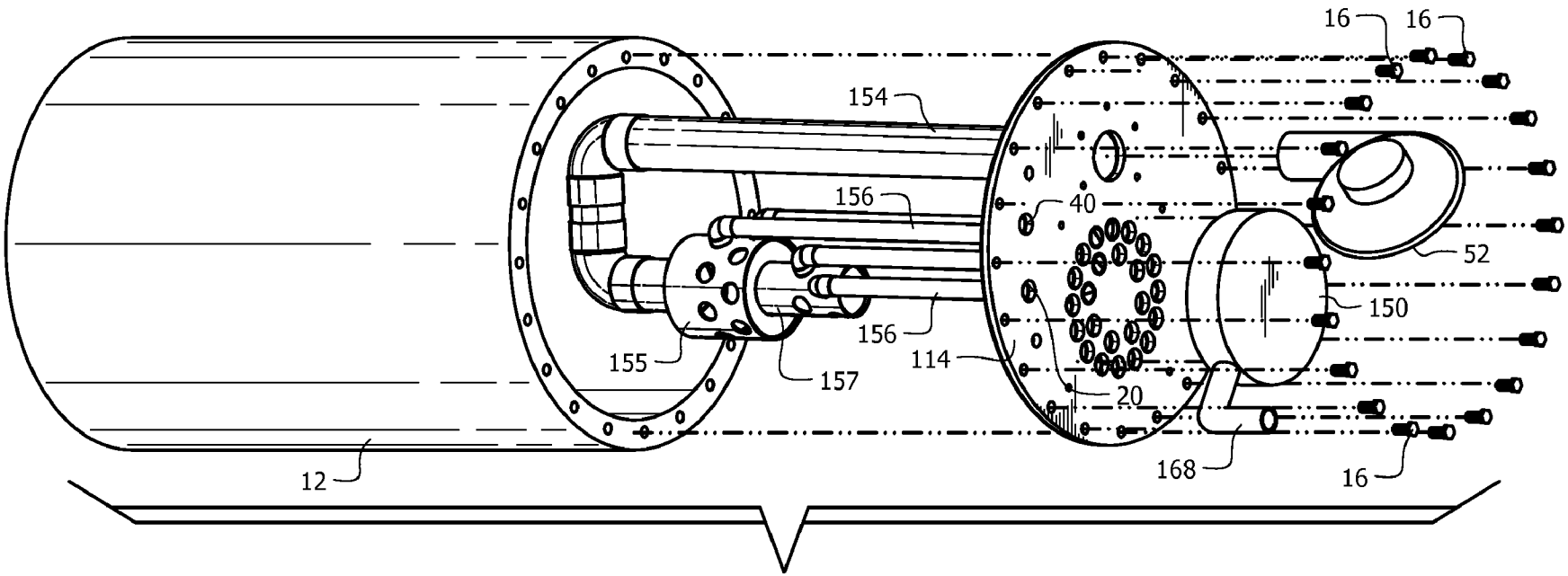
FIG. 9 illustrates an exploded view of a water heater of a second embodiment of the present invention.

Referring to FIG. 9, an exploded view of a water heater of a second embodiment of the present invention is shown without the inner tank, making the heat exchange tubes 156 visible. An exhaust manifold 150 collects exhaust gasses from the heat exchange tubes 156 after the heat exchange tubes 156 pass through the cover plate 114 and funnel the exhaust gasses to an exhaust pipe 168. A source of hot gasses 52 is shown coupled to the heat transfer pipe 154. Any known source of hot gasses 52 is anticipated including, but not limited to, conventional gas, oil or gas/oil burners. In this view, the inner jacket 122 is not shown, allowing a better view of the heat exchange tubes 156 and the 155.

The cover plate 114 is held and sealed to the outer tank 12 using any known method such as using bolts 16. In some embodiments, a seal (not shown) is used between the cover plate 114 and the outer tank 12. Likewise, the exhaust manifold 150 is affixed to the cover plate using any known method such as bolts, welds, adhesives, etc.

Figure 10:
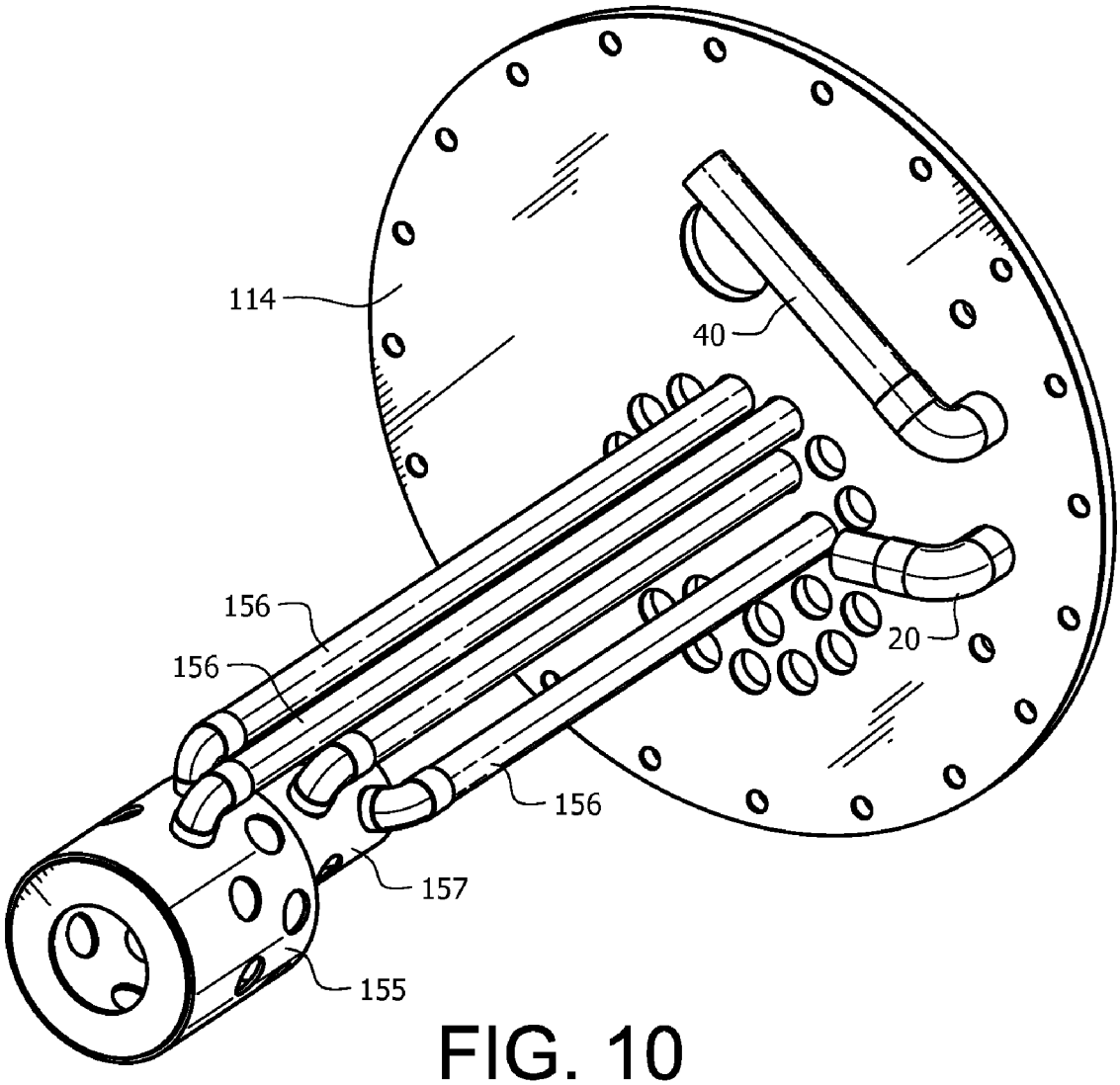
FIG. 10 illustrates a perspective view of a water heater of a second embodiment of the present invention.

Referring to FIG. 10, a perspective view of a water heater of a second embodiment of the present invention is shown. Shown are some of the heat exchange tubes 156 passing between the plenum 155 and the cover plate 114. In some embodiments, the plenum 155 has a smaller, secondary plenum 157 providing an outer set and an inner set of heat exchange tubes 156 organized in two sets of concentric circles as shown.

In the present invention, the water is heated by transferring the water from a water supply into an inner tank which is held within an outer tank and transferring the water from the inner tank into an outer tank and then to supply a building with hot water. The water in the outer tank is heated with hot gasses, partially cooling to intermediate temperature gasses. The water in the inner tank is heated with the intermediate temperature gasses, further cooling the intermediate temperature gasses into cooler gasses that are then exhausted out of the water heater.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A water heater comprising:

an outer tank;

an inner tank contained within the outer tank;

a cover plate having a cold water inlet aperture, a hot water outlet aperture, a heat input aperture and a plurality of exhaust apertures, the cold water inlet aperture coupled into the inner tank, thereby providing a source of cold water to the inner tank and the hot water outlet aperture coupled to the outer tank, thereby providing an exit for heated water from the water heater;

a source of heat forcing hot gasses into the heat input aperture;

a heat transfer pipe, a first end of the heat transfer pipe interfaced to the heat input aperture and a distal second end of the heat transfer pipe interfaced to a plenum;

a plurality of heat exchange tubes, each of the heat exchange tubes interfaced at a first end to the plenum and each of the heat exchange tubes interfaced at a distal second end to one of the plurality of exhaust apertures; and a manifold interfacing the plurality of exhaust apertures to an exhaust pipe.

2. The water heater of claim 1, wherein the plenum further comprises a secondary plenum and the plurality of heat exchange tubes are organized into two concentric circles.

3. The water heater of claim 1, wherein the cold water inlet aperture is coupled to a supply of cold water.

4. The water heater of claim 1, wherein the cover plate is affixed to the outer tank by a plurality of bolts.

5. The water heater of claim 1, wherein the source of heat is a burner.

6. A water heater comprising:

an outer tank;

an inner tank contained within the outer tank;

a cover plate having a cold water inlet aperture, a hot water outlet aperture, a heat input aperture and a plurality of exhaust apertures, the cold water inlet aperture is coupled into the inner tank, thereby providing a source of cold water to the inner tank and the hot water outlet aperture is coupled to the outer tank, thereby providing an exit for heated water from the water heater;

a means for providing hot gasses into the heat input aperture;

a means for transferring the hot gasses from the input aperture to a plenum, the means for transferring hot gasses from the input aperture to the plenum conducts heat from the hot gasses to water present in the outer tank;

a means for transferring the hot gasses from the plenum to the plurality of exhaust apertures, the means for transferring hot gasses from the plenum to the plurality of exhaust apertures conducts heat from the hot gasses to water present in the inner tank; and a means for transferring the hot gasses from the exhaust apertures to an exhaust pipe.

7. The water heater of claim 6, wherein the cold water inlet aperture is coupled to a supply of cold water.

8. The water heater of claim 6, wherein the cover plate is affixed to the outer tank by a plurality of bolts.

9. The water heater of claim 6, wherein the means for providing hot gasses is a burner.

10. The water heater of claim 6, wherein the means for transferring hot gasses from the plenum to the plurality of exhaust apertures also conducts heat to water present in the outer tank.

11. A method of heating water comprising:

transferring water from a water supply into an inner tank, the inner tank held within an outer tank;

transferring the water from the inner tank into an outer tank;

supplying hot water to a building from the outer tank;

heating the water in the outer tank with hot gasses, the water in the outer tank partially cooling the hot gasses into intermediate temperature gasses;

heating the water in the inner tank with the intermediate temperature gasses, the water in the inner tank further cooling the intermediate temperature gasses into cooler gasses; and exhausting the cooler gasses.

12. The method of claim 11, wherein the hot gasses emanate from a burner.

13. The method of claim 11, wherein the step of heating the water in the outer tank is performed by a heat transfer pipe passing through the water in the outer tank.

14. The method of claim 11, wherein the step of heating the water in the outer tank is performed by a heat transfer pipe passing through the water in the outer tank and a plurality of heat exchange tubes, the heat exchange tubes partially exposed to the water in the outer tank.

15. The method of claim 11, wherein the step of heating the water in the inner tank is performed by a plurality of heat exchange tubes passing through the water in the inner tank.

* * * * *